US005634456A

United States Patent [19]

Perrone

[11] Patent Number: 5,634,456

[45] Date of Patent: Jun. 3, 1997

[54] SEMI-AUTOMATIC GUN

[75] Inventor: Aldo Perrone, Brampton, Canada

[73] Assignee: Daisy Manufacturing Company, Inc., Rogers, Ark.

[21] Appl. No.: 546,645

[22] Filed: Oct. 23, 1995

[51] Int. Cl.[6] ..... F41B 11/32; F41B 11/06

[52] U.S. Cl. ..... 124/76; 124/31; 124/74

[58] Field of Search ..... 124/31, 37, 72, 124/73, 74, 76

[56] References Cited

U.S. PATENT DOCUMENTS

| | | | |
|---|---|---|---|
| 2,635,599 | 4/1953 | Wells | 124/76 X |
| 3,103,212 | 9/1963 | Merz | 124/74 X |
| 3,788,298 | 1/1974 | Hale . | |
| 4,850,330 | 7/1989 | Nagayoshi | 124/76 |
| 4,936,282 | 6/1990 | Dobbins et al. | 124/74 |
| 5,349,938 | 9/1994 | Farrell | 124/73 |
| 5,349,939 | 9/1994 | Perrone | 124/76 |
| 5,383,442 | 1/1995 | Tippmann | 124/76 |
| 5,505,188 | 4/1996 | Williams | 124/74 |
| 5,515,838 | 5/1996 | Anderson | 124/76 |

FOREIGN PATENT DOCUMENTS 1 264 128 1/1990 Canada .

*Primary Examiner*—John A. Ricci
*Attorney, Agent, or Firm*—Banner & Allegretti, Ltd.

[57] ABSTRACT

A gun suitable for firing paintballs or pellets using compressed gas having an elongate breech section with a longitudinal passageway formed therein and a handle and barrel connected thereto. A hammer is slidably mounted in the passageway and a spring biases the hammer to a forward, firing position. A gas valve system is arranged in the passageway and is connectible to a source of compressed gas. A trigger includes a sear engaging member slidable in a cavity formed in the trigger. A spring biases this member to a rearward position. A sear with a downwardly extending hook is pivotally mounted on a sear pin. A further spring biases the sear so as to pivot the rear end upwardly into engagement with a flange formed on the bolt of the gun. Preferably the hammer and bolt are rigidly connected together by means of two links positioned on opposite sides of the hammer and bolt to which they are both connected.

39 Claims, 6 Drawing Sheets

SEMI-AUTOMATIC GUN

BACKGROUND OF THE INVENTION

This invention relates to guns in general and in particular to guns suitable for firing pellets or paintballs using compressed gas.

A variety of guns are already known for firing BB's, pellets and, more recently, paintballs. Many of these guns employ a cylinder filled with compressed gas as a source of the compressed gas. These cylinders are sometimes mounted in the handle of the gun and sometimes at the rear of the gun. Also, a variety of trigger and sear mechanisms have been employed in such guns in the past in order to fire the gun and release the compressed gas into the barrel.

The more recent paintball guns can be used in mock "war games" wherein the users of the guns attempt to hit other game participants with a paint pellet. Goggles and other protective wear can be worn during such games to prevent injury. These guns have a larger calibre barrel than previously known BB and pellet guns due to the size of the paintballs used. Semi-automatic guns have been developed for firing paintballs as they are quickly able to fire a number of paintballs by the simple operation of pulling the trigger. In such guns the compressed gas is used not only to fire the paintball from the barrel but also to recock the gun.

Canadian patent No. 1,264,128 which issued Jan. 2, 1990 to Brass Eagle Inc. describes a gun suitable for firing paintballs wherein the source of compressed gas is held in a tube located above the barrel of the gun. The paintballs are able to drop individually into the rear end of the barrel through an opening. The gun is loaded by pulling back on a slidable pump member which slides along the exterior of the barrel. A final rearward movement of this pump member pulls a hammer rearward against the pressure of a hammer spring. Rearward movement of the pump member also draws a bolt rearwardly so that a paintball can drop into the barrel.

Recent U.S. Pat. No. 5,349,939 which issued Sep. 27, 1994 to Brass Eagle Inc. describes a semi-automatic gun having a special trigger and sear mechanism for firing the gun. A hammer is slidably mounted in a breech section of the gun and is rigidly connected by means of a rod to a bolt used to load individual balls into the rear end of the barrel. Mounted between the hammer and the bolt is a gas valve unit that includes a movable valve stem which is struck by the hammer when the gun is fired. This stem is biased rearwardly by a valve spring. The sear device is pivotally mounted on a sear pin which extends through an elongate pole formed in the sear device. There is a sear detent slidably mounted in a front end of the sear and a spring biases this detent to a forward position in order to be engagable by the trigger. The rear end of the sear device is biased upwardly by means of a sear spring so that the sear device will re-engage with the hammer after the gun is fired and the hammer moves back to a rearward position.

It is an object of the present invention to provide a reasonably inexpensive and reliable gun for firing pellets or balls using compressed gas, which gun employs a unique trigger and sear mechanism for firing the gun.

It is a further object of the present invention to provide a gun for firing pellets or balls using compressed gas wherein the hammer and the bolt of the gun are rigidly connected together for simultaneous sliding movement, the connection being two rigid links positioned on opposite sides of the hammer and bolt. The connecting arrangement helps to distribute the forces acting on the hammer and other working parts evenly during operation of the gun.

It is an additional object of the present invention to provide a gun of the aforementioned type which employs a unique, separate, unitary metal housing for the gas valve system, which housing not only provides a gas chamber for compressed gas but also a sleeve section in which the hammer is able to slide.

SUMMARY OF THE INVENTION

According to one aspect of the invention, a gun for firing pellets or balls using compressed gas comprises an elongate breech section having a front end and a main longitudinal passageway formed therein, a gun handle connected to this breech section and a barrel through which the pellets or balls are fired connected to the front end of the breech section. A hammer mechanism, including a hammer slidably mounted in the passageway and a spring biasing the hammer to move to a forward position in the passageway are provided. A gas valve system is arranged in the passageway in front of the hammer and this system is connectible to a source of compressed gas and is constructed to release compressed gas in order to fire a pellet or ball when the hammer mechanism is released. A trigger is pivotally mounted to a lower portion of the breech section, this trigger including a sear engaging member slidable in the trigger. A first biasing device biases this member to a rearward position. Another device pivots the trigger to a forward position upon release of the trigger. A release mechanism for releasing the hammer when the trigger is pulled includes a sear having a rear end, which sear is pivotably mounted on a sear pin that is in turn mounted in the breech section. The release mechanism also includes a further device for biasing the rear end of the sear to pivot upwardly. When the trigger is pulled in order to fire the gun, the trigger pulls the rear end of the sear downwardly causing the hammer to be released and to be driven forwardly by the spring. After the hammer is released, the rear end of the sear is pivoted upwardly by its biasing device to a position where the sear recocks the hammer. Upon release of the trigger, the trigger pivots to its forward position where the trigger is engaged with the sear by means of the sear engaging member.

Preferably a bolt is slidable in the main longitudinal passageway and in a rear section of the barrel and the hammer is connected to the bolt by means of a linkage mechanism.

According to another aspect of the invention, a gun for firing pellets or balls using compressed gas includes an elongate breech section having a front end and a chamber formed therein, a gun handle connected to this section and a barrel through which pellets or balls are fired connected to the front end of the breech section. A hammer and bolt mechanism is also provided in which the hammer is slidably mounted in the chamber and the bolt is slidable between a rear position in the chamber and a forward position at a rear end of the barrel. Connecting apparatus rigidly connects the hammer and the bolt. The hammer is slidable to a rear, cocked position. A spring biases the hammer and bolt mechanism to the forward position for firing the gun. A gas valve system is arranged in the chamber in front of the hammer and is connectible to a source of compressed gas. This system is adapted to release compressed gas into the rear end of the barrel when the hammer mechanism is released. A trigger is movably mounted to a lower portion of the breech section and there is a device for releasing the hammer mechanism when the trigger is pulled. This device includes a sear pivotably mounted on a sear pin, the sear being operable by the trigger. The aforementioned connecting apparatus comprises two rigid links positioned on opposite sides of the hammer and bolt, each link being connected to both the hammer and the bolt.

In a preferred embodiment, each of the rigid links is made from a generally flat metal strip with a forward end section of each link bent inwardly in order to extend into a slot formed in the bolt.

According to a further aspect of the invention, a gun for firing pellets or balls using compressed gas includes an elongate breech section having rear and front ends and an elongate chamber formed therein, the length of this chamber extending in a rear to front direction. A barrel extends forwardly from the front end and a bolt is slidably mounted in the breech section and slidable into the barrel in order to close a rear end thereof. A gas valve system is adapted to release compressed gas into the rear end of the barrel when the gun is fired. This system includes a separate, unitary, metal housing at least a major portion of which is mounted within the chamber and rearwardly of the bolt. The housing has a forward gas chamber which is normally sealed to contain the compressed gas and a rearward, sleeve section. An aperture extends between the gas chamber and the sleeve section and a valve device is biased to a rear position to close off this aperture. A hammer is mounted for sliding movement in the sleeve section, this hammer being slidable to a rear, cocked position. A spring mechanism biases the hammer towards a forward, firing position. A trigger operated firing mechanism is capable of releasing the hammer towards the forward, firing position. In use of the gun, the hammer causes the gas valve system to release compressed gas into the barrel when the hammer reaches the forward, firing position.

Preferably, connecting apparatus rigidly connects the hammer and the bolt for simultaneous sliding movement. In this case, the spring mechanism biases both the hammer and the bolt towards forward positions.

Further features and advantages will become apparent from the following detailed description taken in conjunction with the accompanying drawings.

DETAILED DESCRIPTION OF PREFERRED EMBODIMENT

Figure 1:
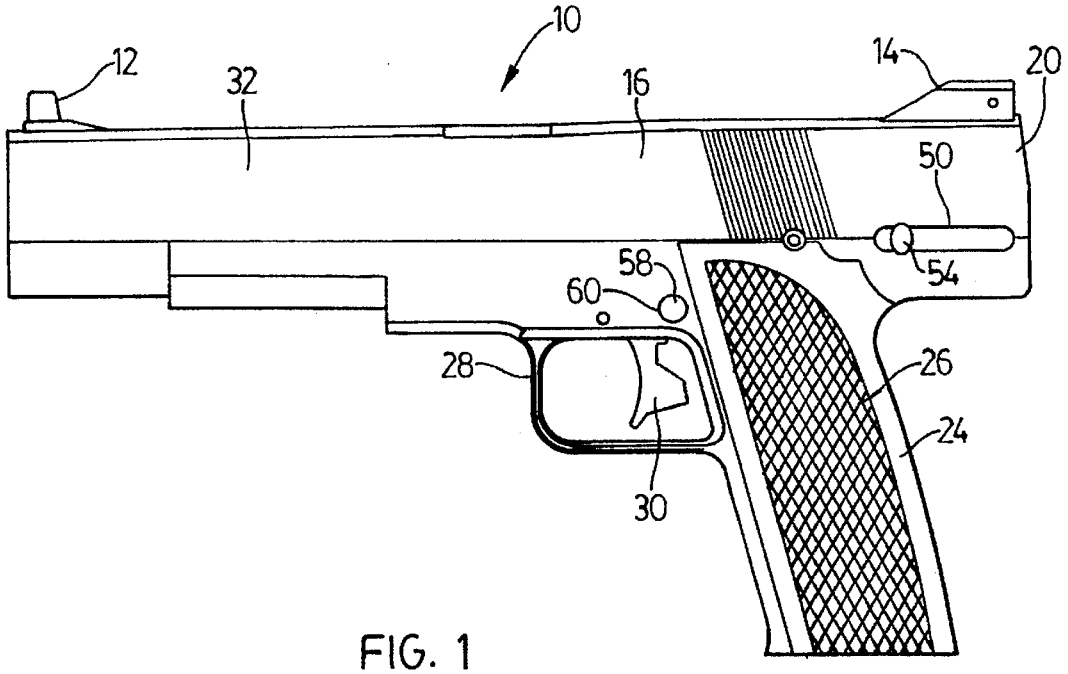
FIG. 1 is a left side view of a semi-automatic gun constructed in accordance with the invention.
Figure 2:
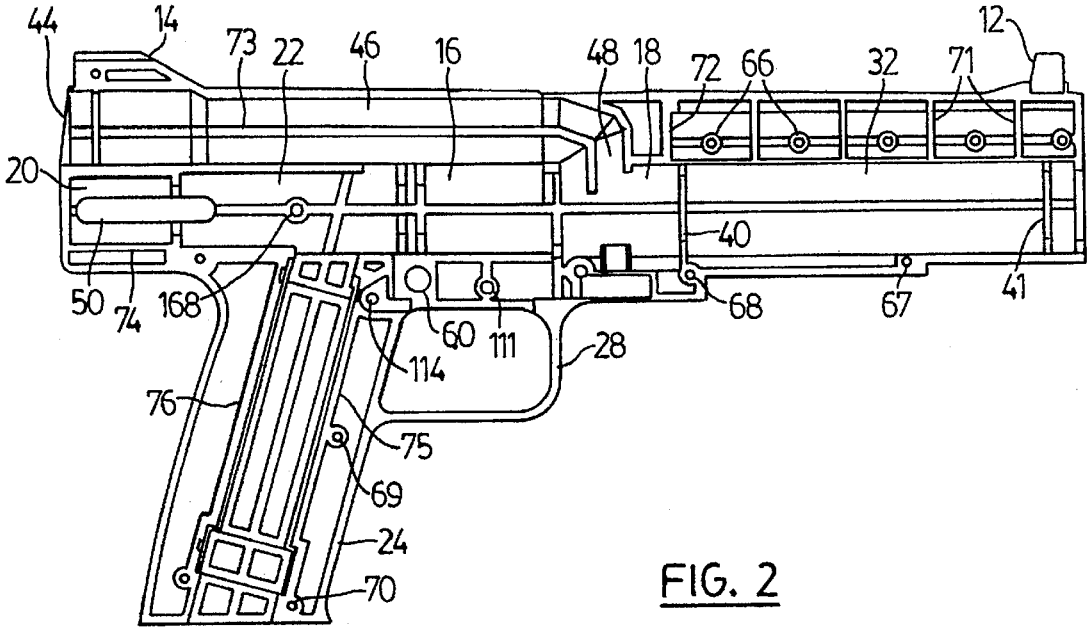
FIG. 2 is a right side view of one half of a plastic exterior housing for the gun of FIG. 1.

A semi-automatic gun 10 constructed in accordance with the invention is shown in FIG. 1. The illustrated gun is constructed to fire paintballs of known construction using compressed gas. The gun has a rigid plastic exterior made up of left and right halves with the left half being shown in FIGS. 1 and 2. The two halves are detachably connected together using suitable connectors or screws. Arranged on top of the gun are front and rear gun sights 12 and 14. The gun includes an elongate breech section 16 having a front end at 18 and a rear end at 20. A main longitudinal passageway or chamber 22, the left half of which is shown in FIG. 2, is formed in this breech section. A gun handle 24 is integrally connected to the breech section and extends downwardly therefrom. The handle may have a roughened exterior at 26 for easy gripping. Located in front of the handle and below the breech section is a trigger guard 28 which extends around and protects a trigger 30 which can also be made of plastic. A forwardly extending section 32 of the plastic exterior surrounds and supports a metal barrel 34 which can be seen clearly in FIGS. 3 and 4. The paintballs are fired through the barrel which is connected to the front end of the breech section. The barrel is formed with circumferentially extending grooves 36 and 38 into which fit supporting ribs 40 and 41 respectively. Thus, the barrel is rigidly held in the plastic housing. A rear section of the barrel is formed with an opening 42 sized to receive a paintball into the rear end of the barrel. The paintballs are loaded into the gun through an opening 44 in the rear end 20 of the breech section. This opening can be closed in any suitable manner to prevent the balls from escaping. A supply of balls is held in a longitudinally extending passageway 46 formed by the plastic housing. This passageway is formed with an opening 48 at its front end to permit balls to enter the rear end of the barrel.

Also shown in FIGS. 1 and 2 is a longitudinally extending slot 50 through which extends a threaded pin member 52 having an exterior knob 54. The pin 52 extends through the rear end of a hammer 56. It will be understood that by pulling back on the knob 54, the user is able to initially bring the hammer to a rearward, cocked position, this position being shown in FIG. 4. The gun may also include a safety pin 58 that extends through a circular opening 60 formed in the housing. Preferably a longitudinally extending slot similar to the slot 50 is also formed on the righthand side of the plastic housing and the pin 52 extends through this right slot. A knob is also provided on the right hand end of the pin and thus the gun can be initially cocked from either the left or right sides.

FIG. 2 also illustrates a number of connecting holes 66 to 70 for connecting the right and left halves of the plastic housing using connecting pins or screws. Also shown are a number of strengthening ribs or internal walls 71 to 76 which can be provided in both halves of the housing. The walls 75 and 76 define a downwardly extending chamber in the handle 24 sized to receive a standard compressed gas cylinder 78 (shown in FIG. 3). Mounted on the inside of the ribs 75 and 76 are two elongate, thin metal plates 79 and 80 between which is the cylinder 78. An internally threaded metal ring 82 is connected to the bottom end of these plates and it threadedly receives a cap or closure (not shown) for closing the opening in the bottom of the handle.

Figure 3:
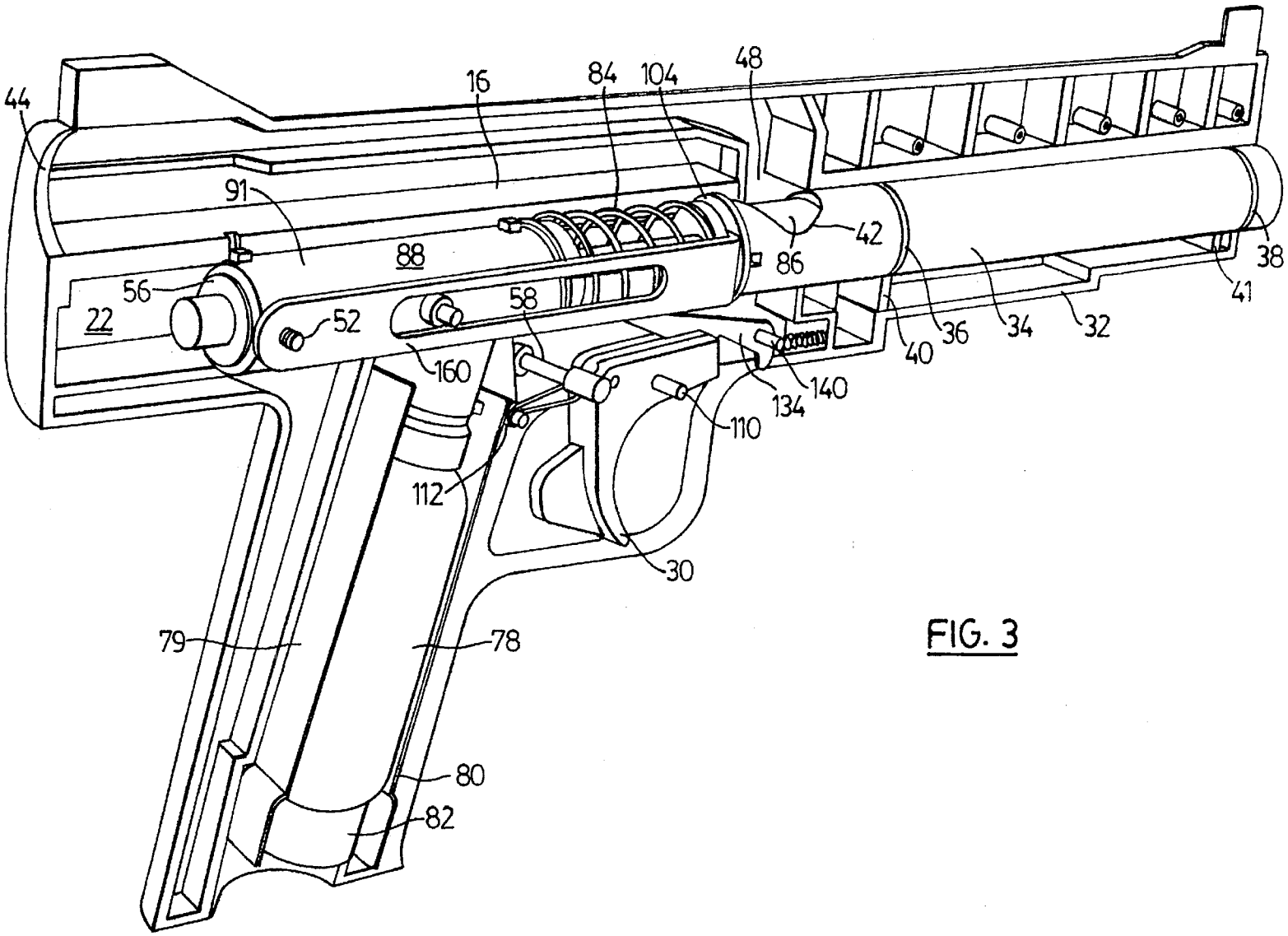
FIG. 3 is a perspective view taken from the rear and right side showing the plastic exterior housing of FIG. 2 with internal working components of the gun mounted therein and the hammer and bolt in their forward positions.
Figure 4:
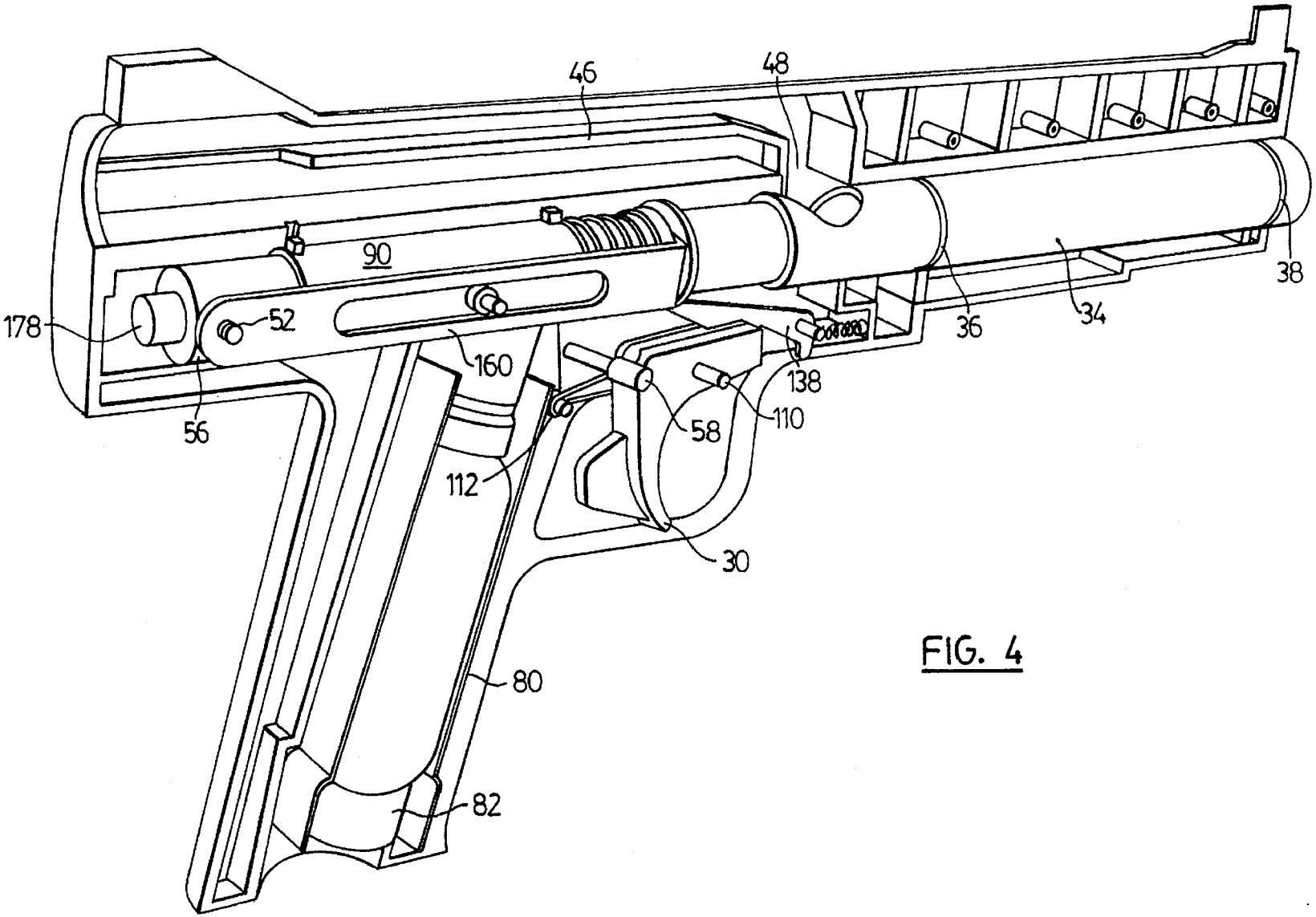
FIG. 4 is a perspective view similar to FIG. 3 but showing the hammer and bolt in their rearward positions with the gun cocked and ready to fire.
Figure 5:
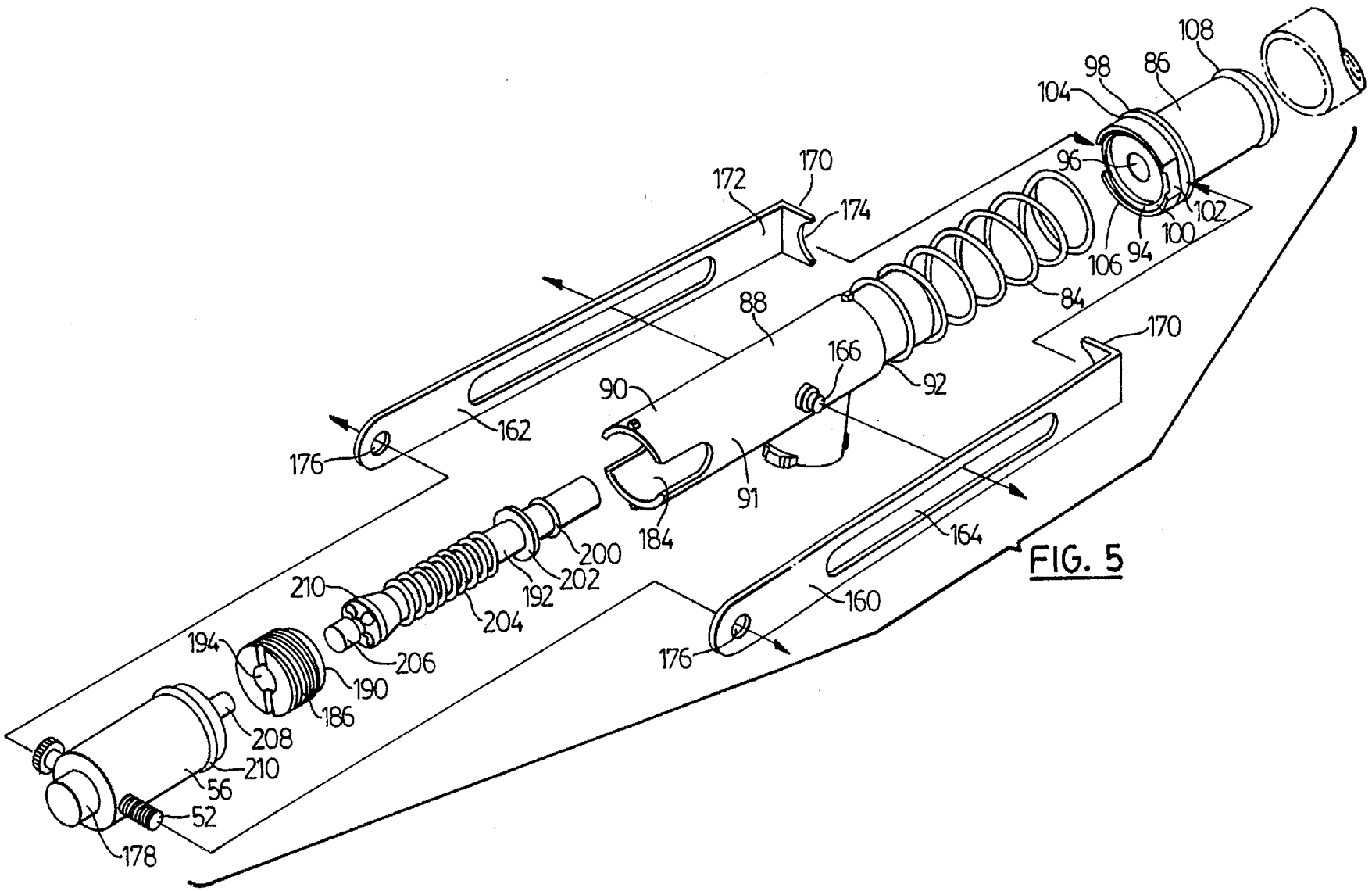
FIG. 5 is a blown apart perspective view showing various working components and their relationship to each other.

Reference will now be made to FIGS. 3 to 5 of the drawings which illustrate the major working components of the gun 10. A suitable coil spring 84 is mounted in the breech section between the hammer 56 and a bolt 86. As explained further hereinafter, in the illustrated preferred embodiment the spring 84 biases both the hammer and the bolt to move to a forward position in the main passageway 22. A gas valve system or unit 88 is arranged in the main passageway 22 in front of the hammer 56. This system 88 is connectible to a source of compressed gas such as the gas cylinder 78 shown. It is constructed to release compressed gas in order to fire a paintball when the hammer 56 is released. The gas valve system includes a separate, unitary metal housing 90, the interior of which is shown in cross-section in FIG. 11. As shown clearly in FIGS. 3 and 4, a major portion 91 of this housing is mounted within the main passageway or chamber 22 and rearwardly of the bolt 86. The major portion 91 of the housing has a forwardly facing, annular shoulder 92 formed thereon and spaced from the front end of the housing. A rear end of the spring 84 rests against this shoulder. A forward end of the spring rests against a suitably formed rear end 94 of the bolt.

The construction of the bolt will now be explained with particular reference to FIG. 5. The preferred bolt 86 is machined from a single piece of steel and it has a central, longitudinally extending passageway 96 extending from its rear end 94 to the front end. The bolt is formed with a radially outwardly extending flange 98 located near the rear end. The bolt is also formed with a radially outwardly projecting rear end section 100 which is flattened on two opposite sides thereof as indicated at 102. The flange 98 is spaced from the rear end section 100 so that a circumferential groove or slot 104 is formed between the flange and the rear end section. This slot forms part of the connecting apparatus for connecting the bolt to the hammer as explained further hereinafter. The preferred rear end section 100 has a rearwardly extending, peripheral lip or rim 106 which can comprise two separate sections as shown. The lip 106 helps to hold or capture the front end of the spring 84 on the rear of the bolt. The front end of the bolt is formed with a circumferentially extending groove that receives and holds an O-ring seal 108. The seal 108 helps to seal the rear end of the barrel when the bolt moves to its forward position shown in FIG. 3. It will also be understood that the compressed gas enters the barrel to fire the paint pellet through the central passageway 96 of the bolt.

The trigger 30 is pivotally mounted to a lower portion of the breech section 16 by means of a pivot pin 110 that extends into a hole 111 formed on each half of the exterior case. A hole is provided in the rear of the trigger for insertion of one end of a trigger spring 112. This spring is mounted on its own pin that extends into hole 114 in the exterior casing. The spring 112 acts to pivot the trigger to a forward position upon release of the trigger.

Figure 9:
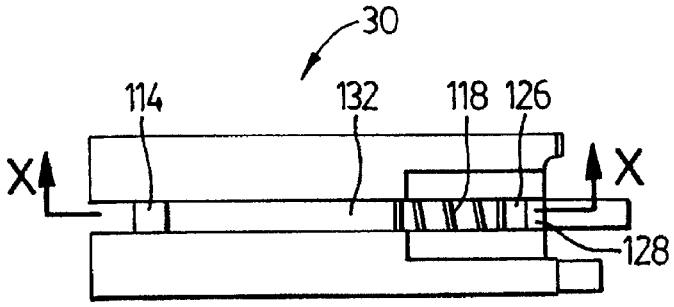
FIG. 9 is a top view of the trigger used in the gun of FIGS. 1 to 4.
Figure 10:
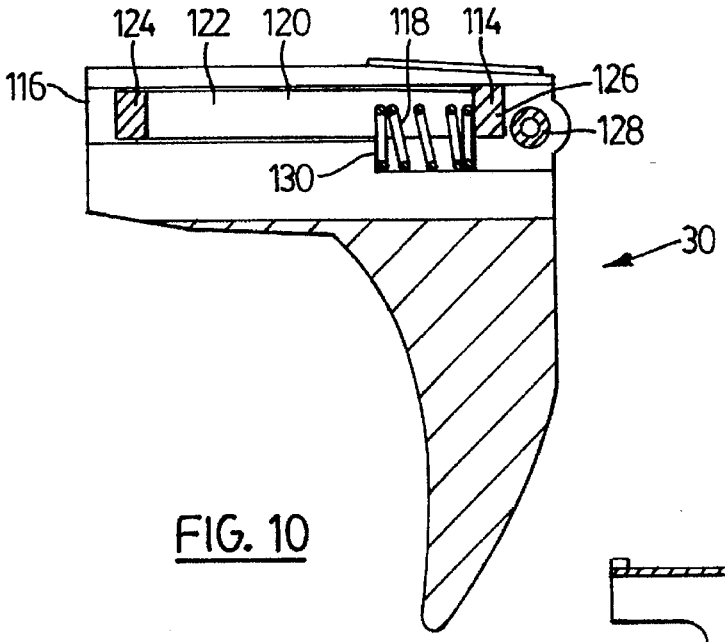
FIG. 10 is a cross-sectional view of the trigger, this view being taken along the line X—X of FIG. 9.

Further details of the preferred trigger can be seen from FIGS. 9 and 10. This preferred trigger includes a sear engaging member 114 slidable in a cavity 116 formed in an upper section of the trigger. A small coil spring 118 provides means for biasing the member 114 to a rearward position, that is the position shown in FIGS. 9 and 10. The member 114 is a generally flat, rectangular member having a hollow interior formed by a central hole at 120. The illustrated preferred embodiment has two longitudinally extending side sections 122, only one of which can be seen in FIG. 10. There are front and rear cross pieces 124 and 126 which connect the side sections together at the front and rear of the member. The coil spring 118 presses against the inside surface of the rear cross piece 126. A stop member in the form of pin 128 prevents the member 114 from coming out of the cavity in the trigger. An internal shoulder 130 formed adjacent the cavity 116 prevents the spring 118 from being pushed forwardly from the position shown. Finally, it will be noted that the top of the trigger has a slot 132 extending from the front end to the rear.

Figure 6:
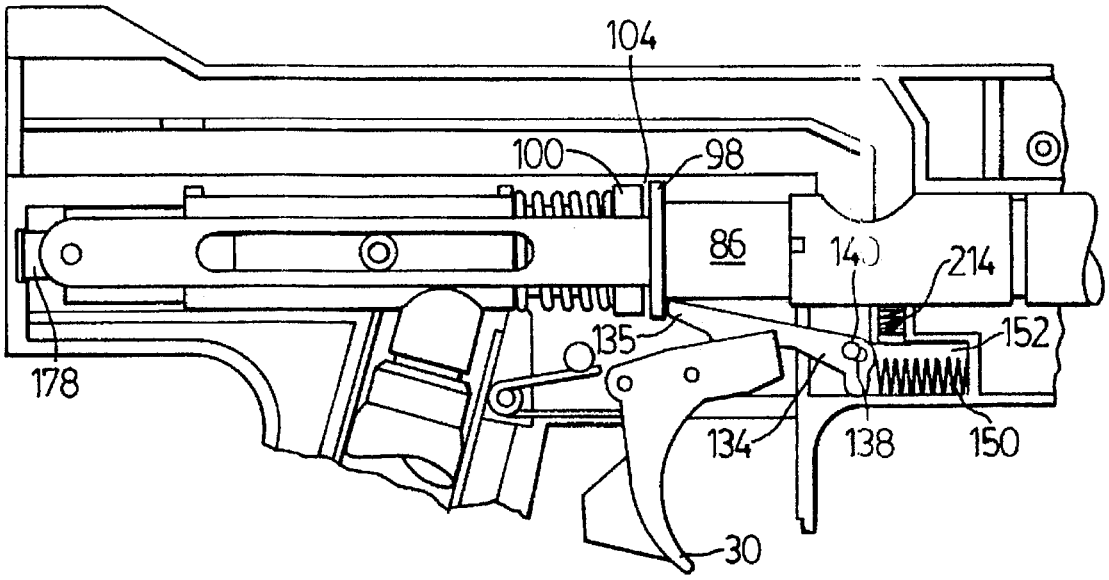
FIG. 6 is a detail view in cross-sectional elevation showing the breech section of the gun and the position of the trigger and sear when the gun is cocked and ready to fire.
Figure 7:
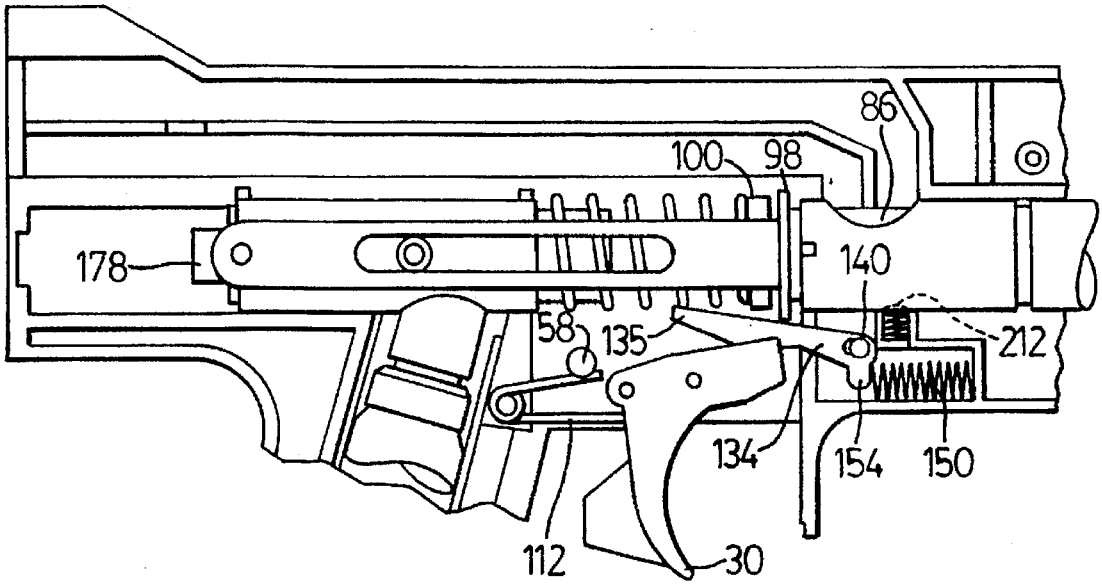
FIG. 7 is a detail view in cross-sectional elevation, similar to FIG. 6, but showing the position of the trigger and sear after the gun has been fired with the hammer and bolt in their forward positions.
Figure 8:
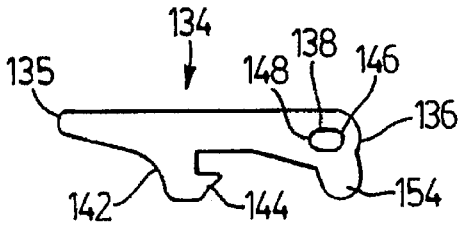
FIG. 8 is a side view of the sear used in the gun of FIGS. 1 to 4.

There are means for releasing the hammer 56 when the trigger 30 is pulled. This releasing mechanism includes a sear 134 which is made from a flat piece of metal such as steel and which has a rear end 135 and a rounded front end 136. The sear has an elongate hole 138 formed therein and through which a sear pin 140 extends. The preferred sear shown in FIG. 8 is formed with a downwardly extending hook 142 that has a forwardly extending lip 144 at the bottom. When the hammer is cocked and the gun is ready to fire, the hook 142 extends around and below the front cross piece 124. This position is shown in FIGS. 4 and 6 of the drawings. In this cocked position, the rear end 135 of the sear engages the aforementioned flange 98 on the bolt, thus preventing both the bolt and the hammer from moving to their forward positions. When the trigger 30 is pulled in order to fire the gun, the trigger 30 pulls the rear end of the sear downwardly by means of the sear engaging member 114 causing the hammer and the bolt to be released and to be driven forwardly by the spring 84. The hole 138 is elongate so it has a forward end 146 and a rearward end 148. As shown in FIG. 6, the sear pin 140 is located at the rearward end of the hole 138 when the hammer is in the rearward, cocked position. As shown in FIG. 7, the sear pin is at the forward end of the hole after the hammer is released. The sear pin is moved to this forward end by a sear spring in the form of horizontally extending coil spring 150. Spring 150 is mounted in a small cylindrical cavity 152 formed by the two half sections of the exterior case. The rear end of spring 150 presses against a short downward extension 154 of the sear. It will be understood that the spring 150 acts as means for biasing the rear end of the sear to pivot upwardly where this rear end can again engage the flange 98 after the gun has been fired. Because the sear is pushed rearwardly by the spring 150 after the trigger is pulled, the hook 142 on the sear is moved to a position where it again can extend downwardly into the central hole 120 formed in the engaging member 114. It will be understood that as soon as the rear end of the sear engages the flange 98, the force of the larger spring 84 overcomes the force of the smaller spring 150 forcing the sear to move to the position shown in FIG. 6. In this position, the lip 144 on the sear will be under the front cross piece of the engaging member 114.

There are link means for connecting the hammer 56 to the bolt for simultaneous sliding movement. The preferred link means for the gun 10 comprises two rigid links 160 and 162, the construction of which can be seen clearly from FIG. 5. These links means for the gun 10 comprise two rigid links 160 and 162, which are connected to opposite sides of the hammer 56 and to opposite sides of the bolt 86. Each link has an elongate slot 164 formed therein and extending lengthwise of the link. The metal housing 90 of the gas valve system is provided with a mounting pin 166 integrally formed on each side thereof. This pin extends through the slot of the adjacent link and into a hole 168 formed in the plastic casing of the gun (see FIG. 2). Thus, the two pins 168 act to hold the housing 90 rigidly in place in the exterior casing. A forward end section 170 of each link is bent inwardly in order to extend into the aforementioned slot 104 formed in the bolt. Each link 160, 162 is preferably made from a generally flat metal strip, preferably a steel strip to provide the required strength and rigidity. As indicated, the bolt is flattened on two opposite sides at 102 on its rear end section. In this way, the flat inner surface 172 of each link rests against the adjacent flattened side of the rear end of the bolt. This helps to keep the links in the correct vertical position and helps to provide a firm connection between the links and the bolt. This connection is enhanced by a semi-circular cut-out 174 formed in each end section 170, the curvature of this cut-out matching the curvature at the bottom of the annular slot 104. A rear end of each link is formed with a hole 176 and through this hole the aforementioned pin member 52 extends so as to connect each link to the hammer. Preferably mounted in the rear end of the hammer is a rubber bumper 178 through which the pin 52 can also extend.

Figure 11:
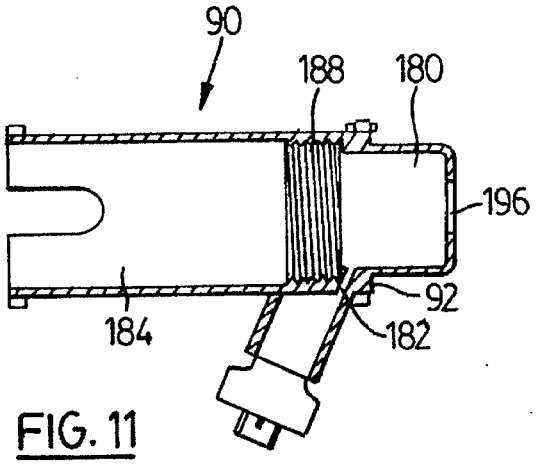
FIG. 11 is a cross-sectional elevation along the longitudinal centerline of the metal housing forming the exterior of the gas valve system for the gun.

The remaining components of the gas valve system will now be detailed with particular reference to FIGS. 5 and 11. The housing 90 has a forward gas chamber located at 180 (see FIG. 11) which is normally sealed to contain the compressed gas that enters the chamber through downwardly extending passageway 182. The housing also has a rearward, sleeve section 184. An aperture or hole extends between the gas chamber and the sleeve section and is formed by a threaded valve nut 186. The nut is threadedly mounted inside housing 90 by means of internal threads 188. In a known manner the front side of the nut at 190 is provided with an annular gas seal. A valve device in the form of an elongate, hollow valve stem 192 is biased to a rear position to close off the aperture 194 in the nut. The valve stem 192 extends through a hole 196 in a front end of the housing 90. The joint between this hole and the valve stem is sealed by means of O-ring 200 which is pressed against the end of the housing by brass washer 202. A valve spring 204 biases the valve stem to its rear, sealing position to close off the aperture 194. The valve stem is formed with a solid end section 206 which extends into the aperture 194. It is this end section that is struck by a centrally located striking pin 208 formed on the front of the hammer when the gun is fired. It will also be understood that a circumferentially extending rim 210 formed on the valve stem engages the seal 190 to close off the gas chamber when the gun is in the cocked position. The valve stem extends into the central passageway 96 in the bolt when the hammer is in a rearward, cocked position. The construction and operation of the valve stem and the valve nut are generally similar to those in the gas valve system described and illustrated in Canadian patent No. 1,264,128. In order for compressed gas to escape the forward gas chamber 180 of housing 90 and enter the barrel though the central passageway 96 in the bolt when striking pin 208 of the hammer drives the valve stern forwardly, the gas must pass around the rim 210 of the valve stern, past seal 190, through openings 211 into the central passageway of the hollow valve stern, and out through the forward end of the valve stern.

It will be particularly noted that the present gun 10 is capable of semi-automatic operation because when the hammer strikes the end of the valve stem not only does compressed gas pass through the valve stem and into the barrel but also some of the compressed gas passes back through the aperture 194 in the valve nut causing the hammer to be driven rearwardly to the cocked position. When the hammer reaches this position, of course, the rear end of the sear is caused to engage the flange on the bolt, thereby holding both the bolt and the hammer in their rearward positions. In this regard, note that an O-ring seal 210 extends around the front end of the hammer so as to seal any gap between the hammer and the metal housing 90. Thus, the full pressure of the gas can be used to drive back the hammer.

Preferably a detent ball 212 is provided in an opening located at the rear end of the barrel to help hold the paintball in position after it is fed into the barrel. This also helps to prevent more than one ball entering the barrel. This ball can be biased upwardly by means of a small coil spring 214 mounted in a small cavity formed in the exterior casing.

It will be readily appreciated by those skilled in the construction of guns that the trigger and sear mechanism of this invention could also be used to fire guns that do not operate using compressed air. In other words, the trigger and sear system of this invention could also be used in guns that fire bullets, particularly semi-automatic guns of this type. Furthermore, it will be appreciated that the trigger and sear mechanism of this invention can also be used in gun constructions wherein the end of the sear engages the hammer directly and not the bolt of the gun. For example, a flange could be formed around the hammer or a recess formed in the bottom of the hammer and the rear end of the sear would engage this flange or the recess in order to hold the hammer in the cocked position.

It will be appreciated by those skilled in this art that various modifications and changes can be made to the gun described herein without departing from the spring or scope of this invention. Accordingly, all such modifications and changes as fall within the scope of the appended claims are intended to be part of this invention.

I hereby claim:

1. A gun for firing pellets or balls using compressed gas comprising:

an elongate breech section having a front end and a main longitudinal passageway formed therein;

a gun handle connected to said breech section;

a barrel through which said pellets or balls are fired connected to said front end of said breech section;

a hammer mechanism, including a hammer slidably mounted in said passageway;

a spring biasing said hammer mechanism to move to a forward position in said passageway;

a gas valve system arranged in said passageway in front of said hammer, said system being connectible to a source of compressed gas and constructed to release compressed gas in order to fire a pellet or ball when said hammer mechanism is released;

a trigger pivotally connected to the breech section, said trigger including a sear engaging member slidable in said trigger and first biasing means for biasing said sear engaging member to a rearward position;

means for pivoting said trigger to a forward position upon release of the trigger;

means for releasing said hammer mechanism when said trigger is pulled, said releasing means including a sear having a rear end and pivotably mounted on a sear pin, which pin is mounted in said breech section, and second biasing means for biasing said rear end of the sear to pivot upwardly;

wherein when said trigger is pulled in order to fire said gun, said trigger pulls said rear end of said sear downwardly causing said hammer mechanism to be released and to be driven forwardly by said spring; after said hammer mechanism is released, the rear end of said sear is pivoted upwardly by said second biasing means to a position where the sear holds said hammer in a cocked position; and upon release of said trigger, the trigger pivots to said forward position where the trigger engages said sear by means of said sear engaging member.

2. A gun according to claim 1 wherein said hammer mechanism includes a bolt slidable in said main longitudinal passageway and in a rear section of said barrel and link means connecting said hammer to said bolt for simultaneous sliding movement.

3. A gun according to claim 2 wherein said sear has an elongate hole formed therein, said hole having a forward end and a rearward end, said sear pin extending through said hole, said sear pin is at said rearward end of the hole when said hammer is in a rearward, cocked position, and said sear pin is at said forward end of the hole after said hammer mechanism is released, said sear pin being moved to said forward end by said second biasing means.

4. A gun according to claim 2 wherein said bolt has a radially outwardly extending flange formed thereon and said rear end of said sear engages said flange when said hammer is in a rearward, cocked position.

5. A gun according to claim 2 wherein said link means comprises two rigid links connected to opposite sides of said hammer and to opposite sides of said bolt.

6. A gun according to claim 5 wherein each link has an elongate slot formed therein and extending lengthwise of the link, said gas valve system being provided with a mounting pin on each side thereof which extends through said slot, and a forward end section of each link is bent inwardly in order to extend into a slot formed on said bolt.

7. A gun according to claim 2 wherein said bolt has a central passageway formed therein which is coaxial with said barrel and said gas valve system includes an elongate valve stem which extends into said central passageway of the bolt when said hammer is in a rearward, cocked position.

8. A gun according to claim 2 wherein said sear engaging member is a generally flat member having a hollow interior, two longitudinally extending side sections, and a cross-piece connecting said side sections together at a front end of the sear engaging member and wherein said sear is formed with a downwardly extending hook adapted to extend around and below said cross-piece.

9. A gun according to claim 1 wherein said second biasing means is a coil spring mounted in said breech section and said first biasing means is a another coil spring mounted in an upper section of said trigger.

10. A gun according to claim 9 wherein said sear engaging member is a generally flat member having a hollow interior, two longitudinally extending side sections, and a cross-piece connecting said side sections together at a front end of the sear engaging member and wherein said sear is formed with a downwardly extending hook adapted to extend around and below said cross-piece.

11. A gun for firing pellets or balls using compressed gas comprising:

an elongate breech section having a front end and a chamber formed therein;

a gun handle connected to said breech section;

a barrel through which said pellets or balls are fired connected to said front end of said breech section;

a hammer and bolt mechanism including a hammer slidably mounted in said chamber, a bolt slidable between a rear position in said chamber and a forward position at a rear end of said barrel, and connecting apparatus for rigidly connecting said hammer and said bolt, said hammer being slidable from a rear, cocked position to a forward, firing position;

a spring biasing said hammer and bolt mechanism to the forward position for firing the gun;

a gas valve system arranged in said chamber in front of said hammer and connectible to a source of compressed gas, said system adapted to release compressed gas into said rear end of the barrel when said hammer and bolt mechanism is released and moves to the forward positions of the hammer and the bolt;

a trigger movably mounted in said breech section; and means for releasing said hammer and bolt mechanism when the trigger is pulled, said releasing means including a sear pivotably mounted on a sear pin, said sear being operable by said trigger;

wherein said connecting apparatus comprises two rigid links positioned on opposite sides of said hammer and bolt, each link being connected to both the hammer and the bolt.

12. A gun according to claim 11 wherein each of said rigid links is made from a generally flat metal strip with a forward end section of each link bent inwardly in order to extend into a slot formed in said bolt.

13. A gun according to claim 12 wherein said bolt is formed with a radially outwardly projecting, annular, rear end section which is flattened on two opposite sides thereof and wherein a flat inner surface of each link rests against an adjacent flattened side of said rear end section.

14. A gun according to claim 13 wherein said bolt also has a radially outwardly extending flange formed thereon and spaced from said rear end section, said slot being formed between said flange and said rear end section, and wherein a rear end of said sear engages said flange when said bolt is in its rear position.

15. A gun according to claim 14 wherein said bolt is machined from a single piece of metal and is formed with a central axial passageway through which compressed gas is released into the barrel by said gas valve system.

16. A gun according to claim 13 wherein said rear end section is formed with a rearwardly extending rim extending along its outer periphery and said spring extends between said gas valve system and said bolt and has a front end, which is captured by said rearwardly extending rim.

17. A gun according to claim 11 wherein each link has an elongate slot formed therein and extending lengthwise of the link and said gas valve system has a mounting pin on each side thereof, each mounting pin acting to secure said gas valve system fixedly in said breech section and extending through the slot in the adjacent link.

18. A gun according to claim 12 wherein a rear end of each link is detachably connected to said hammer by means of a pin member having a knob at one end, said pin member extending out through a slot formed in one side of said breech section, whereby said hammer can be cocked manually by pulling rearwardly on said knob.

19. A gun according to claim 11 wherein said gas valve system includes a metal housing having an elongate upper section which is coaxial with said barrel, a forwardly facing annular shoulder being formed on the exterior of said upper section, and wherein a rear end of said spring rests against said shoulder and a forward end of said spring presses against said bolt.

20. A gun according to claim 19 wherein said sear has a rear end, a spring biases said rear end of the sear to pivot upwardly, and in the cocked position of said hammer, said rear end of the sear engages said bolt, said rear end being disengaged from said bolt when the trigger is pulled.

21. A gun for firing pellets or balls using compressed gas comprising:

an exterior housing forming at least a rear section of the gun;

a gun handle and a barrel connected to said housing; said barrel being provided for firing pellets or balls therethrough;

a hammer slidably mounted in said housing and movable from a rearward, cocked position to a forward, firing position;

a bolt slidably mounted in said housing from a rearward position, where a pellet or ball can enter a rear end of the barrel, to a forward position where the bolt closes said rear end of the barrel;

connecting apparatus for rigidly connecting said hammer and bolt so that they slide together;

a spring mounted in said housing and biasing said bolt and said hammer towards said forward positions;

a gas valve system mounted in said housing in front of said hammer and connectible to a source of compressed gas, said system being capable of releasing compressed gas into the rear end of the barrel when said hammer is released and moves to said firing position;

a trigger pivotably mounted in said housing and having a sear engaging member slidable therein and means for biasing said sear engaging member to a rearward position;

means for releasing said bolt and hammer when the trigger is pulled, said releasing means including a sear pivotably mounted on a sear pin and having a rear end, said sear pin being mounted in said housing, and means for biasing said sear so as to pivot said rear end upwardly;

wherein, when said trigger is pulled, said trigger pulls said rear end of the sear downwardly by means of said sear engaging member, causing both said bolt and hammer to be released and to be driven to the forward positions thereof by said spring.

22. A gun according to claim 21 wherein said sear has an elongate hole formed therein so that the hole has a forward end and a rearward end, said sear pin extends through said hole, said sear pin is at said rearward end of the hole when said hammer is in a rearward, cocked position, and said sear pin is at said forward end of the hole after said hammer is released, said sear pin being moved to said forward end by said means for biasing said sear.

23. A gun according to claim 22 wherein said bolt has a radially extending flange formed on a rear end section thereof and said rear end of said sear engages said flange when the bolt and hammer are in their rearward positions.

24. A gun according to claim 22 wherein both said means for biasing said sear engaging member and said means for biasing said sear are coil springs, the coil spring for biasing the sear being mounted in said housing.

25. A gun according to claim 22 wherein said sear engaging member is a generally flat member having a hole in the center thereof and slidable in a cavity formed in said trigger, and wherein said sear is formed with a downwardly extending hook adapted to extend through said hole in the flat member and to extend under a forward section of said flat member.

26. A gun according to claim 21 wherein said sear engaging member is a generally flat member having a hole in the center thereof and slidable in a cavity formed in said trigger, and wherein said sear is formed with a downwardly extending hook adapted to extend through said hole in the flat member and to extend under a forward section of said flat member.

27. In a gun having a breech section, a bolt slidable in said breech section, a barrel extending forwardly from said breech section, and a hammer slidable from a rearward, cocked position to a forward firing position, and a spring capable of driving said hammer to the forward position, the improvement comprising a firing mechanism including a trigger pivotably connected to said breech section, said trigger having a sear engaging member slidable in said trigger and first biasing means for biasing said sear engaging member to a rearward position; means for pivoting said trigger to a forward position upon release of the trigger; a sear for releasing said hammer to be driven to said forward position by said spring when the sear is pulled downwardly by said sear engaging member, said sear having a rear end and being pivotably mounted on a sear pin; and second biasing means for biasing said rear end of the sear upwardly to an engagement position where the sear prevents said hammer from being driven to said forward position.

28. A gun according to claim 27 wherein said bolt and said hammer are rigidly connected to each other for simultaneous sliding movement in said breech section and said rear end of the sear engages said bolt in said engagement position and thereby prevents said hammer from being driven to said forward position.

29. A gun according to claim 28 wherein said sear pin extends through an enlarged hole in said sear, said sear pin being located in a rear part of the hole when said hammer is in said rearward, cocked position, and said sear pin being located in a front part of the hole after said hammer is released to move to said forward position.

30. A gun according to claim 29 wherein said sear engaging member is generally flat and has a central aperture formed therein and said sear has a downwardly extending hook capable of extending through said central aperture and engaging a bottom side of the sear engaging member.

31. A gun for firing pellets or balls using compressed gas comprising:

a breech section having rear and front ends and an elongate chamber formed therein, the length of said chamber extending in a rear to front direction;

a barrel extending forwardly from said front end;

a bolt slidably mounted in said breech section and slidable into said barrel in order to close a rear end thereof;

a gas valve system adapted to release compressed gas into said rear end of the barrel when the gun is fired, said system including a separate, unitary metal housing, at least a major portion of which is mounted within said chamber and rearwardly of said bolt, said housing having a forward gas chamber which is normally sealed to contain the compressed gas and a rearward, sleeve section, an aperture extending between said gas chamber and the sleeve section, and a valve device biased to a rear position to close off said aperture;

a hammer mounted for sliding movement in said sleeve section, said hammer being slidable to a rear, cocked position;

a spring mechanism that biases said hammer towards a forward, firing position; and a trigger operated firing mechanism capable of releasing said hammer towards said forward, firing position;

wherein said hammer causes said gas valve system to release said compressed gas into the barrel when said hammer reaches the forward, firing position.

32. A gun according to claim 31 including connecting apparatus for rigidly connecting said hammer and said bolt for simultaneous sliding movement, wherein said spring mechanism biasing both said hammer and said bolt towards forward positions.

33. A gun according to claim 32 wherein said firing mechanism includes a trigger and a sear both of which are pivotally mounted in said breech section and wherein a rear end of said sear engages said bolt in order to hold said hammer in said rear, cocked position.

34. A gun according to claim 33 wherein said valve device is an elongate, hollow valve stem which extends through a hole in a front end of said housing and wherein a valve spring extends around said valve stem and biases said valve stem to said rear position to close off said aperture.

35. A gun according to claim 34 wherein said gas valve system includes a valve nut threadedly mounted inside said housing and separating said gas chamber from said sleeve section, said aperture extending through said valve nut and a solid end section of said valve stem extending into said aperture, said end section being struck by said hammer in the firing position thereof.

36. A gun according to claim 34 wherein said metal housing has a forwardly facing, annular shoulder formed thereon and spaced from said front end of the housing and a rear end of said spring mechanism, that biases said hammer, rests against said shoulder.

37. A gun according to claim 32 wherein said connecting apparatus comprises two rigid links positioned on opposite sides of said hammer and bolt, each link being separately connected to both the hammer and the bolt.

38. A gun according to claim 37 wherein each of said rigid links is made from a generally flat metal strip with a forward end section of each link bent inwardly in order to extend into a slot formed in said bolt.

39. A gun according to claim 37 wherein each link has an elongate slot formed therein and extending lengthwise of the link and said metal housing has a fixed mounting pin projecting from each side thereof, each mounting pin acting to secure said metal housing in said breech section and extending through the slot in the adjacent link.

* * * * *